US006060437A

United States Patent [19]

Robson et al.

[11] Patent Number: 6,060,437

[45] Date of Patent: May 9, 2000

[54] LUBRICATING OIL COMPOSITIONS

[75] Inventors: Robert Robson; Trevor Anthony Brettell, both of Oxfordshire, United Kingdom

[73] Assignee: Exxon Chemical Patents, Inc., Linden, N.J.

[21] Appl. No.: 09/124,133

[22] Filed: Jul. 29, 1998

[30] Foreign Application Priority Data

Aug. 1, 1997 [GB] United Kingdom ..... 9716283

[51] Int. Cl.[7] ..... C10M 111/04; C10M 137/06

[52] U.S. Cl. ..... 508/371; 508/368; 508/372; 508/373; 508/376; 508/294

[58] Field of Search ..... 508/371, 368, 508/372, 373, 376, 294

[56] References Cited

U.S. PATENT DOCUMENTS

| | | | |
|---|---|---|---|
| 5,254,275 | 10/1993 | Beltzer et al. | 508/444 |
| 5,387,346 | 2/1995 | Hartley et al. | 508/287 |
| 5,397,487 | 3/1995 | Pillon et al. | 508/306 |
| 5,490,946 | 2/1996 | Beltzer et al. | 508/272 |
| 5,602,086 | 2/1997 | Le et al. | 508/591 |
| 5,641,731 | 6/1997 | Baumgart et al. | 508/183 |
| 5,703,023 | 12/1997 | Srinivasan | 508/468 |
| 5,728,656 | 3/1998 | Yamaguchi et al. | 508/371 |
| 5,750,750 | 5/1998 | Duncan et al. | 508/485 |
| 5,858,932 | 1/1999 | Dasai et al. | 508/371 |

OTHER PUBLICATIONS

Smalheer et al, Lubricant Additives, 1967, pp. 1–11.

*Primary Examiner*—Jerry D. Johnson
*Attorney, Agent, or Firm*—Ohlandt, Greeley, Ruggiero & Perle

[57] ABSTRACT

A lubricating oil composition for internal combustion engines comprises:

(A) a major amount of a basestock of lubricating viscosity containing from greater than 35 to less than 70 mass % of one or more PAO's, the balance preferably being one or more Group I basestocks as defined in API 1509; and (B) two or more additive components such as an ashless dispersant and a metal detergent.

17 Claims, No Drawings

LUBRICATING OIL COMPOSITIONS

This invention relates to lubricating oil compositions for internal combustion engines for use in the crankcase thereof.

Manufacturers of internal combustion engines are interested in increasing the period, expressed in terms of mileage or time, between required changes of crankcase lubricant in use in their engines in motor vehicles. Lubricant formulators are addressing the problem and tests have been devised that are a measure of the lubricant's ability to remain in use in the crankcase for longer—in terms of mileage or time—than hitherto. Such tests may be referred to as "long drain suitability tests". An example of such a test is the VW PV 1449 test for gasoline engines.

The present invention is concerned with improving performance in "long drain suitability tests" without the need to use expensive, specialised formulations, by providing a defined basestock in a lubricating oil composition.

Basestocks, sometimes referred to as base oils, used in lubricating oil compositions may comprise synthetic or natural oils used as crankcase lubricating oils for spark-ignited and compression-ignited engines. The lubricating oil basestock conveniently has a kinematic viscosity of 2.5 to 12 $mm^2/s$ and preferably 2.5 to 9 $mm^2/s$ at 100° C. The viscosity characteristic of a basestock is typically expressed by the neutral number of the oil (e.g. S150N) with a higher neutral number being associated with a higher viscosity at a given temperature. This number is defined as the viscosity of the basestock at 40° C. measured in Saybolt Universal Seconds. The average basestock neutral number (ave. BSNN) of a blend of straight cuts may be determined according to the following formula:

$$\log(\text{ave}.BSNN) = \left[BSR1 \times \log\frac{BSNN1}{100}\right] + \left[BSR2 \times \log\frac{BSNN2}{100}\right] + \ldots \left[BSRn \times \log\frac{BSNNn}{100}\right]$$

where BSRn=basestock ratio for basestock n

=(wt % basestock n/wt % total basestock in oil)×100%

BSNNn=basestock neutral number for basestock n

Basestocks with lower solvent neutral numbers are used for lower viscosity grades. For example, a typical basestock will have a BSNN between 90 and 180.

GB-A-2 292 747 describes automotive crankcase lubricants containing a polar dispersant and a base oil containing from 20 to 70% of PAO (polyalphaolefin) oil, and specifically exemplifies 35 and 20% and prefers 15 to 25%. It states that the lubricants preferably include a detergent. It further states that the lubricants are compatible with fluorocarbon and nitrile material used in engine seals.

However, a problem with the lubricants described in GB-A-2 292 747 is that, when they contain PAO in the percentages specified therein, they would either give rise to high viscosity increase in engine tests, as evidenced herein, at the lower percentages of PAO described or become expensive at the high percentage of PAO described.

The present invention is concerned with use of intermediate quantities of PAO to meet the aforesaid problem.

Thus, a first aspect of the invention is a lubricating oil composition for an internal combustion engine comprising:

(A) a major amount of a basestock of lubricating viscosity containing from greater than 35 to less than 70, such as from 37 to 68, preferably from 40 to 60, mass % of one or more Group IV basestocks; and (B) two or more additive components.

Preferably, the balance of the basestock is one or more basestocks selected from Group I basestocks. Groups I and IV are defined below.

Preferably the basestock contains from greater than 40 to less than 60, such as 42 to 58, preferably 45 to 55, mass % of said one or more Group IV basestocks.

A second aspect of the invention is a method of making a lubricating oil composition comprising blending (A) and (B), each of (A) and (B) being as defined in the first aspect.

A third aspect of the invention is a method of operating an internal combustion engine, such as a spark-ignited engine, comprising lubricating the engine with a lubricating oil composition of the first aspect or made by the method of the second aspect.

A fourth aspect of the invention is a method for increasing the period between crankcase lubricant changes in a spark-ignited engine comprising treating moving surfaces thereof with a lubricating oil composition comprising, or made by blending, (A) a major amount of a basestock of lubricating viscosity containing from 25 to 80, such as 25 to 70, mass % of one or more Group IV basestocks, as defined herein, or of a mixture thereof; and (B) two or more additive components, such as of the first aspect or made by the method of the second aspect.

The features of the invention will now be discussed in further detail as follows.

(A) BASESTOCK

The basestock conveniently has a viscosity of 2 to 20 such as 2.5 to 12 cSt at 100° C., advantageously 2.5 to 9 cSt at 100° C., preferably 3 to 7 cSt at 100° C.

Basestocks may be made using a variety of different processes including but not limited to distillation, solvent refining, hydrogen processing, oligomerisation, esterification, and rerefining. API 1509 "Engine Oil Licensing and Certification System" Fourteenth Edition, December 1996 states that all basestocks are divided into five general categories:

Group I contain less than 90% saturates and/or greater than 0.03% sulfur and have a viscosity index greater than or equal to 80 and less than 120;

Group II contain greater than or equal to 90% saturates and less than or equal to 0.03% sulfur and have a viscosity index greater than or equal to 80 and less than 120;

Group III contain greater than or equal to 90% saturates and less than or equal to 0.03% sulfur and have a viscosity index greater than or equal to 120;

Group IV are polyalphaolefins (PAO); and

Group V include all other basestocks not included in Group I, II, III or IV.

The test methods used in defining the above groups are ASTM D2007 for saturates; ASTM D2270 for viscosity index; and one of ASTM D2622, 4294, 4927 and 3120 for sulfur.

Group IV basestocks, i.e. polyalphaolefins (PAO) include hydrogenated oligomers of an alpha-olefin, the most important methods of oligomerisation being free radical processes, Ziegler catalysis, and cationic, Friedel-Crafts catalysis.

The polyalphaolefins typically have viscosities in the range of 2 to 20 cSt at 100° C., preferably 4 to 8 cSt at 100° C. They may, for example, be oligomers of branched or straight chain alpha-olefins having from 2 to 16 carbon atoms, specific examples being polypropenes, polyisobutenes, poly-1-butenes, poly-1-hexenes, poly-1-octenes and poly-1-decene. Included are homopolymers, interpolymers and mixtures. PAO's are described in "Chemistry and Technology of Lubricants" edited by R. M. Mortier and S. T. Orszulik, published by Blackie (Glasgow) and VCH Publishers Inc. N.Y. (1992): Ch 2 Synthetic base fluids.

Regarding the balance of the basestock referred to above, a "Group I basestock" also includes a Group I basestock with which basestock(s) from one or more other groups is or are admixed, provided that the resulting admixture has characteristics falling within those specified above for Group I basestocks.

(B) ADDITIVE COMPONENTS

Examples are as follows:

ASHLESS DISPERSANTS

Examples are high molecular weight ashless dispersants include the range of ashless dispersants known as effective for adding to lubricant oils for the purpose of reducing the formation of deposits in gasoline or diesel engines. By "high molecular weight" is meant having a number average molecular weight of between 700 and 5000 such as between 1300 and 1400. A wide variety of such compounds is available, as now described in more detail.

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

Processes for reacting polymeric hydrocarbons with unsaturated carboxylic acids, anhydrides or esters and the preparation of derivatives from those compounds are disclosed in U.S. Pat. Nos. 3,087,936, 3,172,892, 3,215,707, 3,231,587, 3,231,587, 3,272,746, 3,275,554, 3,381,022, 3,442,808, 356,804, 3,912,764, 4,110,349, 4,234,435 and GB-A-1440219.

A class of ashless dispersants comprising ethylene alpha-olefin copolymers and alpha-olefin homo- and copolymers prepared using new metallocene catalyst chemistry, which may have a high degree (e.g. >30%) of terminal vinylidene unsaturation is described in U.S. Pat. Nos. 5,128,056, 5,151,204, 5,200,103, 5,225,092, 5,266,223, 5,334,775; WO-A-94/19436, 94/13709; and EP-A440506, 513157, 513211. These dispersants are described as having superior viscometric properties as expressed in a ratio of CCS viscosity to kV 100° C.

The term "alpha-olefin" is used herein to denote an olefin of the formula

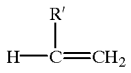

wherein R' is preferably a $C_1$–$C_{18}$ alkyl group. The requirement for terminal vinylidene unsaturation refers to the presence in the polymer of the following structure:

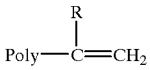

wherein Poly is the polymer chain and R is typically a $C_1$–$C_{18}$ alkyl group, typically methyl or ethyl. Preferably the polymers will have at least 50%, and most preferably at least 60%, of the polymer chains with terminal vinylidene unsaturation. As indicated in WO-A-94/19426, ethylene/1-butene copolymers typically have vinyl groups terminating no more than about 10 percent of the chains, and internal mono-unsaturation in the balance of the chains. The nature of the unsaturation may be determined by FTIR spectroscopic analysis, titration or C-13 NMR.

The oil-soluble polymeric hydrocarbon backbone may be a homopolymer (e.g., polypropylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, e.g., 1 to 10 mole %, is an α,ω-diene, such as a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene). Atactic propylene oligomers typically having an $\overline{Mn}$ of from 700 to 5000 may also be used, as described in EP-A490454, as well as heteropolymers such as polyepoxides.

One preferred class of olefin polymers is polybutenes and specifically poly-n-butenes, such as may be prepared by polymerization of a $C_4$ refinery stream. Other preferred classes of olefin polymers are EAO copolymers that preferably contain 1 to 50 mole % ethylene, and more preferably 5 to 48 mole % ethylene. Such polymers may contain more than one alpha-olefin and may contain one or more $C_3$ to $C_{22}$ diolefins. Also useable are mixtures of EAO's of varying ethylene content. Different polymer types, e.g., EAO, may also be mixed or blended, as well as polymers differing in $\overline{Mn}$ ; components derived from these also may be mixed or blended.

The olefin polymers and copolymers used in the dispersant employed in the invention preferably have an $\overline{Mn}$ of from 700 to 5000, more preferably 1300 to 4000. Polymer molecular weight, specifically $\overline{Mn}$ , can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method, particularly for lower molecular weight polymers, is vapor pressure osmometry (see, e.g., ASTM D3592).

The degree of polymerisation $D_p$ of a polymer is:

$$D_p = \sum_i \frac{Mn \times \text{mol. \% monomer } i}{100 \times \text{mol. wt monomer } i}$$

and thus for the copolymers of two monomers $D_p$ may be calculated as follows:

$$D_p = \frac{Mn \times \text{mol. \% monomer 1}}{100 \times \text{mol. wt monomer 1}} + \frac{Mn \times \text{mol. \% monomer 2}}{100 \times \text{mol. wt monomer 2}}$$

Preferably, the degree of polymerisation for the polymer backbones used in the invention is at least 45, typically from 50 to 165, more preferably 55 to 140.

Particularly preferred copolymers are ethylene butene copolymers.

Preferably, the olefin polymers and copolymers may be prepared by various catalytic polymerization processes using metallocene catalysts which are, for example, bulky ligand transition metal compounds of the formula:

$$[L]_m M[A]_n$$

where L is a bulky ligand; A is a leaving group, M is a transition metal, and m and n are such that the total ligand valency corresponds to the transition metal valency. Preferably the catalyst is four co-ordinate such that the compound is ionizable to a $1^+$ valency state.

The ligands L and A may be bridged to each other, and if two ligands A and/or L are present, they may be bridged. The metallocene compound may be a full sandwich compound having two or more ligands L which may be cyclopentadienyl ligands or cyclopentadienyl derived ligands, or they may be half sandwich compounds having one such ligand L. The ligand may be mono- or polynuclear or any other ligand capable of $\eta$-5 bonding to the transition metal.

One or more of the ligands may $\pi$-bond to the transition metal atom, which may be a Group 4, 5 or 6 transition metal and/or a lanthanide or actinide transition metal, with zirconium, titanium and hafnium being particularly preferred.

The ligands may be substituted or unsubstituted, and mono-, di-, tri, tetra- and penta-substitution of the cyclopentadienyl ring is possible. Optionally the substituent(s) may act as one or more bridges between the ligands and/or leaving groups and/or transition metal. Such bridges typically comprise one or more of a carbon, germanium, silicon, phosphorus or nitrogen atom-containing radical, and preferably the bridge places a one-atom link between the entities being bridged, although that atom may and often does carry other substituents.

The metallocene may also contain a further displaceable ligand, preferably displaced by a cocatalyst—a leaving group—that is usually selected from a wide variety of hydrocarbyl groups and halogens.

Such polymerizations, catalysts, and cocatalysts or activators are described, for example, in U.S. Pat. Nos. 4,530,914, 4,665,208, 4,808,561, 4,871,705, 4,897,455, 4,937,299, 4,952,716, 5,017,714, 5,055,438, 5,057,475, 5,064,802, 5,096,867, 5,120,867, 5,124,418, 5,153,157, 5,198,401, 5,227,440, 5,241,025; EP-A-129368, 277003, 277004, 420436, 520732; and WO-A-91/04257, 92/00333, 93/08199, 93/08221, 94/07928 and 94/13715.

The oil-soluble polymeric hydrocarbon backbone may be functionalized to incorporate a functional group into the backbone of the polymer, or as one or more groups pendant from the polymer backbone. The functional group typically will be polar and contain one or more hetero atoms such as P, O, S, N, halogen, or boron. It can be attached to a saturated hydrocarbon part of the oil-soluble polymeric hydrocarbon backbone via substitution reactions or to an olefinic portion via addition or cycloaddition reactions. Alternatively, the functional group can be incorporated into the polymer in conjunction with oxidation or cleavage of the polymer chain end (e.g., as in ozonolysis).

Useful functionalization reactions include: halogenation of the polymer at an olefinic bond and subsequent reaction of the halogenated polymer with an ethylenically unsaturated functional compound (e.g., maleation where the polymer is reacted with maleic acid or anhydride); reaction of the polymer with an unsaturated functional compound by the "ene" reaction absent halogenation; reaction of the polymer with at least one phenol group (this permits derivatization in a Mannich base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil-soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g. polyalkylene and polyoxyalkylene polyamines of about 2 to 60, conveniently 2 to 40 (e.g., 3 to 20), total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine.

Other useful amine compounds include: alicyclic diamines such as 1,4-di(aminomethyl) cyclohexane, and heterocyclic nitrogen compounds such as imidazolines. A particularly useful class of amines are the polyamido and related amido-amines as disclosed in U.S. Pat. Nos. 4,857,217; 4,956,107; 4,963,275; and 5,229,022. Also useable is tris(hydroxymethyl)amino methane (THAM) as described in U.S. Pat. Nos. 4,102,798; 4,113,639; 4,116,876; and UK 989,409. Dendrimers, star-like amines, and comb-structure amines may also be used. Similarly, one may use the condensed amines disclosed in U.S. Pat. No. 5,053,152. The functionalized polymer is reacted with the amine compound according to conventional techniques as described in EP-A 208,560; U.S. Pat. Nos. 4,234,435 and 5,229,022.

The functionalized oil-soluble polymeric hydrocarbon backbones also may be derivatized with hydroxy compounds such as monohydric and polyhydric alcohols or with aromatic compounds such as phenols and naphthols. Polyhydric alcohols are preferred, e.g., alkylene glycols in which the alkylene radical contains from 2 to 8 carbon atoms. Other useful polyhydric alcohols include glycerol, monooleate of glycerol, monostearate of glycerol, monomethyl ether of glycerol, pentaerythritol, dipentaerythritol, and mixtures thereof. An ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding ashless dispersants comprise the ether-alcohols and including, for example, the oxy-alkylene, oxy-arylene. They are exemplified by ether-alcohols having up to 150 oxy-alkylene radicals in which the alkylene radical contains from 1 to 8 carbon atoms. The ester dispersants may be di-esters of succinic acids or acidic esters, i.e., partially esterified succinic acids, as well as partially esterified polyhydric alcohols or phenols, i.e., esters having free alcohols or phenolic hydroxyl radicals. An ester dispersant may be prepared by one of several known methods as illustrated, for example, in U.S. Pat. No. 3,381,022.

A preferred group of ashless dispersants includes those substituted with succinic anhydride groups and reacted with polyalkylene amines, such as polyethylene amines (e.g., tetraethylene pentamine), aminoalcohols such as trismethylolaminomethane and optionally additional reactants such as alcohols and reactive metals e.g., pentaerythritol, and combinations thereof). Also useful are dispersants wherein a polyamine is attached directly to the backbone by the methods shown in U.S. Pat. Nos. 3,275,554 and 3,565,804 where a halogen group on a halogenated hydrocarbon is displaced with various alkylene polyamines.

Another class of ashless dispersants comprises Mannich base condensation products. Generally, these are prepared by condensing about one mote of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a polymer product of a metallocene cataylsed polymerisation as a substituent on the benzene group or may be reacted with a compound containing such a polymer substituted on a succinic anhydride, in a manner similar to that shown in U.S. Pat. No. 3,442,808.

Examples of functionalized and/or derivatized olefin polymers based on polymers synthesized using metallocene catalyst systems are described in publications identified above.

The dispersant can be further post-treated by a variety of conventional post treatments such as boration, as generally taught in U.S. Pat. Nos. 3,087,936 and 3,254,025. This is readily accomplished by treating an acyl nitrogen-containing dispersant with a boron compound selected from the group consisting of boron oxide, boron halides, boron acids and esters of boron acids, in an amount to provide from about 0.1 atomic proportion of boron for each mole of the acylated nitrogen composition to about 20 atomic proportions of boron for each atomic proportion of nitrogen of the acylated nitrogen composition. Usefully the dispersants contain from about 0.05 to 2.0 wt. %, e.g. 0.05 to 0.7 wt. % boron based on the total weight of the borated acyl nitrogen compound. The boron, which appears be in the product as dehydrated boric acid polymers (primarily $(HBO_2)_3$), is believed to attach to the dispersant imides and diimides as amine salts e.g., the metaborate salt of the diimide. Boration is readily carried out by adding from about 0.05 to 4, e.g., 1 to 3 wt. % (based on the weight of acyl nitrogen compound) of a boron compound, preferably boric acid, usually as a slurry, to the acyl nitrogen compound and heating with stirring at from 135° to 190° C., e.g., 140°–170° C., for from 1 to 5 hours followed by nitrogen stripping. Alternatively, the boron treatment can be carried out by adding boric acid to a hot reaction mixture of the dicarboxylic acid material and amine while removing water.

Also, B may be provided separately, for example as a B ester or as a B succinimide, made for example from a polyisobutylene succinic anhydride, where the polymer has a molecular weight of from 450 to 700.

Particularly useful compositions of the invention are those containing ashless dispersants based on poly(isobutylene) polymers having a number average molecular weight of from 900 to 2500, substituted with succinic anhydride groups which have been further functionalised. Preferably, the dispersant contains at least 1.0, and desirably at least 1.3 succinic groups per polymer group. A preferred functionalising class of compounds contains at least one NH< group. Generally, functionalisation is effected using from 0.5 equivalents to 2 moles of amine compound per equivalent of succinic anhydride substituted polymer.

Other preferred ashless dispersants are the functionalised and derivatised olefin polymers based on ethylene alpha-olefin polymers previously described, produced using metallocene catalyst systems. These, preferably, have number average molecular weights of from 1600 to 3500.

OIL-SOLUBLE METAL DETERGENTS

Metal-containing or ash-forming detergents function both as detergents to reduce or remove deposits and as acid neutraliziers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralised detergent as the outler layer of a metal base (e.g. carbonate) micelle. Such overbased detergents may have a TBN of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium and magnesium sulfonates having TBN of from 20 to 450 TBN, and neutral and overbased calcium phenates and sulfurized phenates having TBN of from 50 to 450.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaqphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt % (preferably at least 125 wt %) of that stoichiometrically required.

Metal salts of phenols and sulfurised phenols are prepared by reaction with an appropriate metal compound such as an oxide or hydroxide and neutral or overbased products may be obtained by methods well known in the art. Sulfurised phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

ANTIWEAR AND ANTIOXIDANT AGENTS

Dihydrocarbyl dithiophosphate metal salts are frequently used as antiwear and antioxidant agents. The metal may be an alkali or alkaline earth metal, or aluminium, lead, tin, molybdenum, manganese, nickel or copper. The zinc salts are most commonly used in lubricating oil in amounts of 0.1 to 10, preferably 0.2 to 2 wt %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralising the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to use of an excess of the basic zinc compound in the neutralisation reaction.

The preferred zinc dihydrocarbyl dithiophosphates are oil soluble salts of dihydrocarbyl dithiophosphoric acids and may be represented by the following formula:

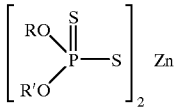

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulphide, oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. While these materials may be used in small amounts, preferred embodiments of the present invention are free of these compounds. They are preferably used in only small amounts, i.e., up to 0.4 wt %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulphur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil soluble aromatic amines having at least two aromatic groups attached directly to one amine nitrogen should preferably not exceed 0.4 wt % active ingredient.

OTHER COMPONENTS

Examples are metal rust inhibitors, viscosity index improvers, corrosion inhibitors, other oxidation inhibitors, friction modifiers, other dispersants, anti-foaming agents, anti-wear agents, pour point depressants, and rust inhibitors. Some are discussed in further detail below.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprenelbutadiene, as well as the partially hydrogenated homopolymers of butadiene and isoprene.

Friction modifiers and fuel economy agents which are compatible with the other ingredients of the final oil may also be included. Examples are esters formed by reacting carboxylic acids and anhydrides with alkanols such as glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine. The amines may be used as such or in the form of an adduct or reaction product with a boron compound such as a boric oxide, boron halide, metaborate, boric acid or a mono-, di- or trialkyl borate. Other friction modifiers are known. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

A viscosity index improver dispersant functions both as a viscosity index improver and as a dispersant. Examples of viscosity index improver dispersants include reaction products of amines, for example polyamines, with a hydrocarbyl-substituted mono -or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated monocarboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono-or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen—containing monomer thereon or by grafting an unsaturated acid onto the polymer backbone and then reacting carboxylic acid groups of the grafted acid with an amine, hydroxy amine or alcohol.

Examples of dispersants and viscosity index improver dispersants may be found in European Patent Specification No. 24146 B.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

The amines may be used as such or in the form of an adduct or reaction product with a boron compound such as a boric oxide, boron halide, metaborate, boric acid or a mono-, di- or trialkyl borate. Other friction modifiers are known. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of non-ionic polyoxyalkylene polyols and esters thereof, polyoxylalkylene phenols, and anionic alkyl sulfonic acids may be used.

Copper and lead bearing corrosion inhibitors may be used. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4.097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives.

A small amount of a demulsifying component may be used. A preferred demulsifying component is described in EP 330,522. It is obtained by reacting an alkylene oxide with an adduct obtained by reacting a bis-epoxide with a polyhydric alcohol. This demulsifier may be used at a level not exceeding 0.1 mass % active ingredient. A treat rate of 0.001 to 0.05 mass % active ingredient is convenient.

Some of the above-mentioned additives can provide a multiplicity of effects; thus for example, a single additive may act as a dispersant-oxidation inhibitor. This approach is well known and need not be further elaborated herein.

Each additive is typically blended into the basestock oil in an amount which enables the additive to provide its desired function.

Representative effect amounts of such additives, when used in crankcase lubricants, are listed below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal Detergents | 0.1–15 | 0.2–9 |
| Corrosion Inhibitor | 0–5 | 0–1.5 |
| Metal Dihydrocarbyl Dithiophosphate | 0.1–6 | 0.1–4 |
| Antioxidant | 0–5 | 0.01–2 |
| Pour Point Depressant | 0.01–5 | 0.01–1.5 |
| Antifoaming Agent | 0–5 | 0.001–0.15 |
| Supplemental Antiwear Agents | 0–1.0 | 0–0.5 |
| Friction Modifier | 0–5 | 0–1.5 |
| Viscosity Modifier | 0.01–10 | 0.25–3 |
| Basestock | Balance | Balance |

All weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

The components may be incorporated into a base oil in any convenient way. Thus, each of the components can be added directly to the oil by dispersing or dissolving it in the oil at the desired level of concentration. The individual components may be singly or in sub-combinations. Thus the detergent system is present when individual detergents are added so that collectively the features of the system are present. Such blending may occur at ambient temperature or at an elevated temperature.

Preferably all the additives except for the viscosity modifier and the pour point depressant are blended into a concentrate or additive package described, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

It will be understood that the various components of the composition, the essential components as well as the optimal and customary components, may react under the conditions of formulation, storage, or use, and that the invention also provides the product obtainable or obtained as a result of any such reaction.

While the dispersant and individual detergent components may be added to the concentrate singly, a particularly preferred concentrate is made by preblending the dispersant with the entire detergent system in accordance with the method described in U.S. Pat. No. 4,938,880. That patent describes making a premix of dispersant and metal detergents that is pre-blended at a temperature of at least about 100° C. for a period of 1 to 10 hours. Thereafter the pre-mix is cooled to at least 85° C. and the additional components are added.

The final formulations may employ from 2 to 15 mass % and preferably 5 to 15 mass %, typically about 10 mass % of the concentrate or additive package with the remainder being base oil.

The invention is applicable to a variety of lubricant viscosity grades such as SAE 0W-X, SAE 5W-X, and SAE 10W-X, where X is 20, 30, 40 or 50.

EXAMPLES

This invention will be further understood by reference to the following examples, wherein all parts are parts by weight, unless otherwise noted and which include preferred embodiments of the invention.

TEST PROCEDURE

The procedure used was the VW PV 1449, or T-4 test procedure, which is run in a 2.0 litre, 62 kW, four cylinder gasoline engine. The procedure is as follows. After a 10 hour "run in" and a 2 hour "flush run", the engine is run for 248 hours on test comprising 192 hours of a cyclic procedure and 56 hours of constant speed running. No oil "top up" is permitted during the test. At the end of the test procedure, the used oil is assessed for viscosity, viscosity increase and total base number. The pistons from the engine are assessed for "ring stick" and piston cleanliness.

The VW 502.00 specification of March 1997, Central Standard 57 221 describes limits for VW acceptance of a lubricant.

Experience has shown that viscosity increase is a critical parameter, the limit being approximately 130% with an adjustment derived from reference oil testing.

FORMULATIONS TESTED

A series of four SAE 10W40 multigrade crankcase lubricating oils meeting API SH/CD specifications was prepared from a basestock, a detergent inhibitor package (DI package) containing an ashless dispersant, ZDDP antioxidant, metal-containing detergents, friction modifier, demulsifier and an antifoam agent, and a separate viscosity modifier which is an oil solution of an ethylene-propylene copolymer having 25 SSI. The ashless dispersant was a conventional borated polyisobutenyl succinimide dispersant (PIBSA/PAM).

The four test oils differed primarily in the content of polyalphaolefin (PAO) as follows:

| Oil | A | 1 | 2 | 3 |
|---|---|---|---|---|
| PAO Content (mass %) | 10 | 29.9 | 45 | 50 |

The mineral oil content and viscosity modifier treat rate were also adjusted because of the changing PAO content.

The four lubricants were tested in the above-described VW PV 1449 procedure.

TEST RESULTS

At the end of the engine test the viscosity increases of these lubricant were found to be:

| Oil | A | 1 | 2 | 3 |
|---|---|---|---|---|
| Viscosity Increase (%) | 301 | 190 | 103 | 64.5 |

The PAO used in the oils was a polyalphaolefin with a nominal viscosity at 100° C. of 6 cSt. Oil A is a comparison oil and oils 1, 2 and 3 are oils of the invention.

It is therefore seen that the viscosity increase is significantly diminished by use of increasing proportions of PAO in the basestock, to the extent that test oils 2 and 3 easily meet the demanding viscosity increase requirements of the VW PV 1449 procedure.

What is claimed is:

1. A lubricating oil composition for an internal combustion engine meeting the viscosity increase requirements of a VW PV 1449 test procedure, said composition comprising:

(A) a major amount of a basestock of lubricating viscosity containing from 42 to 58 mass % of one or more Group IV basestocks having a viscosity in the range of 2 to 20 cSt at 100° C., or of a mixture thereof, the balance of the basestock being one or more Group I, Group II or Group III basestocks; and (B) two or more additive components, at least one being a dihydrocarbyl dithiophosphate metal salt.

2. The composition of claim 1 wherein the balance of the basestock is one or more Group I basestocks.

3. The composition of claim 2 wherein the basestock contains from 45 to 55 mass % of said one or more Group IV basestocks.

4. The composition of claim 2 wherein the or each Group IV basestock is an oligomer of a branched or straight chain alpha-olefin having from 2 to 16 carbon atoms.

5. The composition of claim 1 wherein the basestock contains from 45 to 55 mass % of said one or more Group IV basestocks.

6. The composition of claim 1 wherein the or each Group IV basestock is an oligomer of a branched or straight chain alpha-olefin having from 2 to 16 carbon atoms.

7. The composition of claim 1 wherein the additive components include one or more ashless dispersants and one or more metal detergents.

8. The composition of claim 7 wherein the one or more ashless dispersants includes a dispersant comprising a polymeric hydrocarbon backbone substituted with succinic anhydride and reacted with a polyalkylene amine.

9. The composition of claim 7 wherein the metal detergent is an oil-soluble neutral or overbased sulfonate, phenate or salicylate of calcium or of magnesium.

10. A method of making a lubricating oil composition comprising blending (A) and (B), each of (A) and (B) being as defined in claim 1.

11. A method of operating an internal combustion engine comprising lubricating the engine with a lubricating oil composition made by the process of claim 10.

12. A method for increasing the period between crankcase lubricant oil changes in a spark-ignited engine comprising treating moving surface thereof with a lubricating oil composition made by the process of claim 10.

13. A method of operating an internal combustion engine comprising lubricating the engine with a lubricating oil composition of claim 1.

14. The method of claim 13 wherein the engine is a spark-ignited engine.

15. The method of claim 13 wherein the or each Group IV basestock is an oligomer of a branched or straight chain alpha-olefin having from 2 to 16 carbon atoms, the balance of the basestock is one or more Group I basestocks, the additive components include one or more ashless dispersants and one or more metal dispersants wherein the one or more ashless dispersants include a dispersant comprising a polymeric hydrocarbon backbone substituted with succinic anhydroxide and reacted with a polyalkylene amine, and the metal detergent is an oil-soluble neutral or overbased sulfonate, phenate or salicylate of calcium or magnesium.

16. A method for increasing the period between crankcase lubricant oil changes in a spark-ignited engine comprising treating moving surfaces thereof with a lubricating oil meeting the viscosity increase requirements of a VW PV 1449 test procedure, said composition comprising:

(A) a major amount of a basestock of lubricating viscosity containing 42 to 58 mass % of one or more Group IV basestocks having a viscosity in the range of 2 to 20 cSt at 100° C., or of a mixture thereof, the balance being one or more Group I, Group II or Group III basestocks; and (B) two or more additive components, at least one being a dihydrocarbyl dithiophosphate metal salt.

17. The method of claim 16 wherein the or each Group IV basestock is an oligomer of a branched or straight chain alpha-olefin having from 2 to 16 carbon atoms, the balance of the basestock is one or more Group I basestocks, the additive components include one or more ashless dispersants and one or more metal dispersants wherein the one or more ashless dispersants include a dispersant comprising a polymeric hydrocarbon backbone substituted with succinic anhydroxide and reacted with a polyalkylene amine, and the metal detergent is an oil-soluble neutral or overbased sulfonate, phenate or salicylate of calcium or magnesium.

* * * * *